US006035838A

United States Patent [19]

Tozzi et al.

[11] Patent Number: 6,035,838

[45] Date of Patent: Mar. 14, 2000

[54] CONTROLLED ENERGY IGNITION SYSTEM FOR AN INTERNAL COMBUSTION ENGINE

[75] Inventors: Luigi P. Tozzi, Columbus; Robert R. Atherton, Indianapolis, both of Ind.

[73] Assignee: Cummins Engine Company, Inc., Columbus, Ind.

[21] Appl. No.: 09/063,142

[22] Filed: Apr. 20, 1998

[51] Int. Cl.[7] ..... F02P 3/04

[52] U.S. Cl. ..... 123/618; 123/620; 123/624; 123/654

[58] Field of Search ..... 123/618, 620, 123/621, 624, 651, 653, 654, 143 R, 644

[56] References Cited

U.S. PATENT DOCUMENTS

| | | | |
|---|---|---|---|
| 3,368,540 | 2/1968 | Ault . | |
| 3,718,124 | 2/1973 | Burley . | |
| 4,077,377 | 3/1978 | Jundt et al. . | |
| 4,117,818 | 10/1978 | Bodig et al. . | |
| 4,303,977 | 12/1981 | Kobashi et al. . | |
| 4,506,650 | 3/1985 | Shimojo et al. | 123/620 |
| 4,512,303 | 4/1985 | Watanabe . | |
| 4,639,871 | 1/1987 | Sakai et al. . | |
| 4,862,370 | 8/1989 | Arnold et al. . | |
| 4,886,037 | 12/1989 | Schleupen . | |
| 4,915,086 | 4/1990 | Ciliberto et al. . | |
| 4,969,439 | 11/1990 | Scotson . | |
| 4,996,967 | 3/1991 | Rosswurm et al. . | |
| 5,038,744 | 8/1991 | Martin et al. . | |
| 5,197,448 | 3/1993 | Porreca et al. . | |
| 5,247,919 | 9/1993 | Akaki et al. . | |
| 5,255,209 | 10/1993 | Krebs . | |
| 5,327,320 | 7/1994 | Fischer . | |
| 5,404,853 | 4/1995 | Ishigami et al. . | |
| 5,513,618 | 5/1996 | Rich et al. . | |
| 5,555,862 | 9/1996 | Tozzi . | |
| 5,619,959 | 4/1997 | Tozzi . | |
| 5,623,412 | 4/1997 | Masson et al. . | |
| 5,668,311 | 9/1997 | Kiess et al. . | |
| 5,886,476 | 3/1999 | Skinner et al. | 123/621 |

FOREIGN PATENT DOCUMENTS 0 457 383 A2 11/1991 European Pat. Off. .

*Primary Examiner*—Tony M. Argenbright
*Assistant Examiner*—Arnold Castro, Jr.
*Attorney, Agent, or Firm*—Baker & Daniels

[57] ABSTRACT

A controlled energy ignition system for an internal combustion engine includes an ignition coil having a primary coil and a secondary coil coupled to first and second electrodes of an ignition plug defining a spark gap therebetween, wherein the primary coil is responsive to activation of a control signal to produce a spark voltage across the secondary coil and across the spark gap. The secondary coil is responsive to the spark voltage to produce a discharge current across the spark gap of the ignition plug. In accordance with one aspect of the invention, means are provided to draw discharge current away from the ignition plug to thereby limit the discharge current to below a threshold current value within some predefined time period after activation of the control signal. In accordance with another aspect of the present invention, means are provided for establishing a supplemental voltage across at least a portion of either the primary or secondary coil to thereby produce a supplemental discharge current across the spark gap. The ignition system of the present invention is accordingly operable to control the discharge current throughout an ignition event to thereby minimize electrode erosion while optimizing ignition of the air-fuel mixture.

18 Claims, 10 Drawing Sheets

CONTROLLED ENERGY IGNITION SYSTEM FOR AN INTERNAL COMBUSTION ENGINE

FIELD OF THE INVENTION

The present invention relates generally to ignition systems for internal combustion engines, and more specifically to controlling spark energy in such systems.

BACKGROUND OF THE INVENTION

In conventional inductive ignition systems for internal combustion engines, spark plug discharge current is typically characterized by an initial high current peak followed by a subsequent current decay. An example of such a conventional discharge current waveform 150 is illustrated in FIG. 6.

Another class of ignition systems include specially configured spark plugs which are operable to propel the arc away therefrom to facilitate combustion of lean air-fuel mixtures. One example of such a spark plug includes a magnet positioned about the electrodes, wherein the magnetic field is operable to propel the arc outwardly from the plug. One embodiment of such a spark plug is described in U.S. Pat. Nos. 5,555,862 and 5,619,959 to Tozzi, which is assigned to the assignee of the present invention, and the disclosures of which are incorporated herein by reference. With such spark plugs of this nature, two key goals are to maximize the ability to ignite fuel at lean air-fuel mixtures while also maximizing electrode life. Unfortunately, the conventional discharge current waveform 150 illustrated in FIG. 8 is not optimized to further either of these goals. Excessive discharge current too early in the ignition event results in excessive electrode erosion while inadequate discharge current near the end of the ignition event results in poor combustion.

What is therefore needed in an arc-propelling spark plug based ignition system is a system for controlling spark plug discharge current throughout an ignition event to thereby achieve the dual goals of maximizing the ability to ignite fuel at lean air-fuel mixtures while also maximizing electrode life.

SUMMARY OF THE INVENTION

The foregoing shortcomings of the prior art are addressed by the present invention. In accordance with one aspect of the present invention, a controlled energy ignition system for an internal combustion engine, comprises an ignition plug having first and second electrodes defining a spark gap therebetween, an ignition coil connected to the first and second electrodes of the ignition plug, the ignition coil responsive to a control signal to produce a discharge current across the spark gap, and a resistor connected across the spark gap, the resistor sized to limit the discharge current below a first threshold current level within a first predefined time period following generation of the control signal.

In accordance with another aspect of the present invention, a controlled energy ignition system for an internal combustion engine, comprises an ignition plug having first and second electrodes defining a spark gap therebetween, an ignition coil having a primary coil coupled to a secondary coil, the primary coil responsive to a first control signal to induce a spark voltage across the secondary coil, the secondary coil responsive to the spark voltage to produce a discharge current across the spark gap, means for sensing the spark voltage and producing a spark voltage signal corresponding thereto, a variable resistor connected across the spark gap and responsive to a second control signal to adjust a resistance value thereof, and a control computer responsive to the spark voltage signal to produce the second control signal, thereby adjusting the resistance value of the variable resistor as a function of the spark voltage signal.

In accordance with a further aspect of the present invention, a controlled energy ignition system for an internal combustion engine, comprises an ignition plug having first and second electrodes defining a spark gap therebetween, an ignition coil connected to the first and second electrodes of the ignition plug, the ignition coil responsive to a control voltage to produce a first discharge current across the spark gap, and means for producing a supplemental voltage separate from the control voltage across at least a portion of the ignition coil, the ignition coil responsive to the supplemental voltage to produce a second discharge current across the spark gap, the second discharge current supplementing the first discharge current.

One object of the present invention is to provide an improved ignition system for an internal combustion engine.

Another object of the present invention is to provide such an ignition system operable to control discharge current to thereby minimize electrode erosion while also optimizing ignitability of the air-fuel mixture.

These and other objects of the present invention will become more apparent from the following description of the preferred embodiment.

DESCRIPTION OF THE PREFERRED EMBODIMENT

Figure 1:
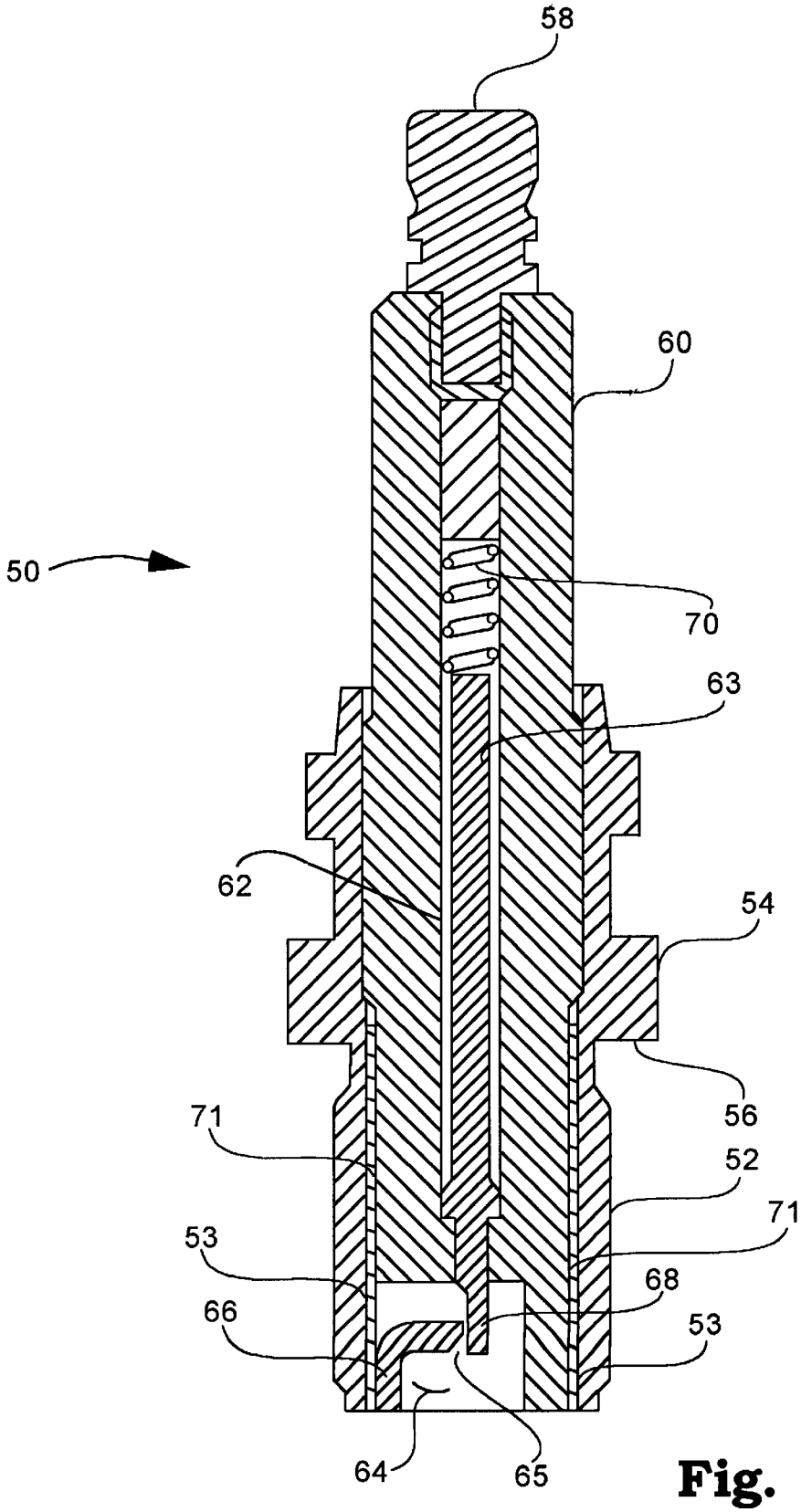
Fig. 1 (Prior Art)
FIG. 1 is a cross-sectional diagram of one prior art spark plug for use with the present invention.
Figure 2:
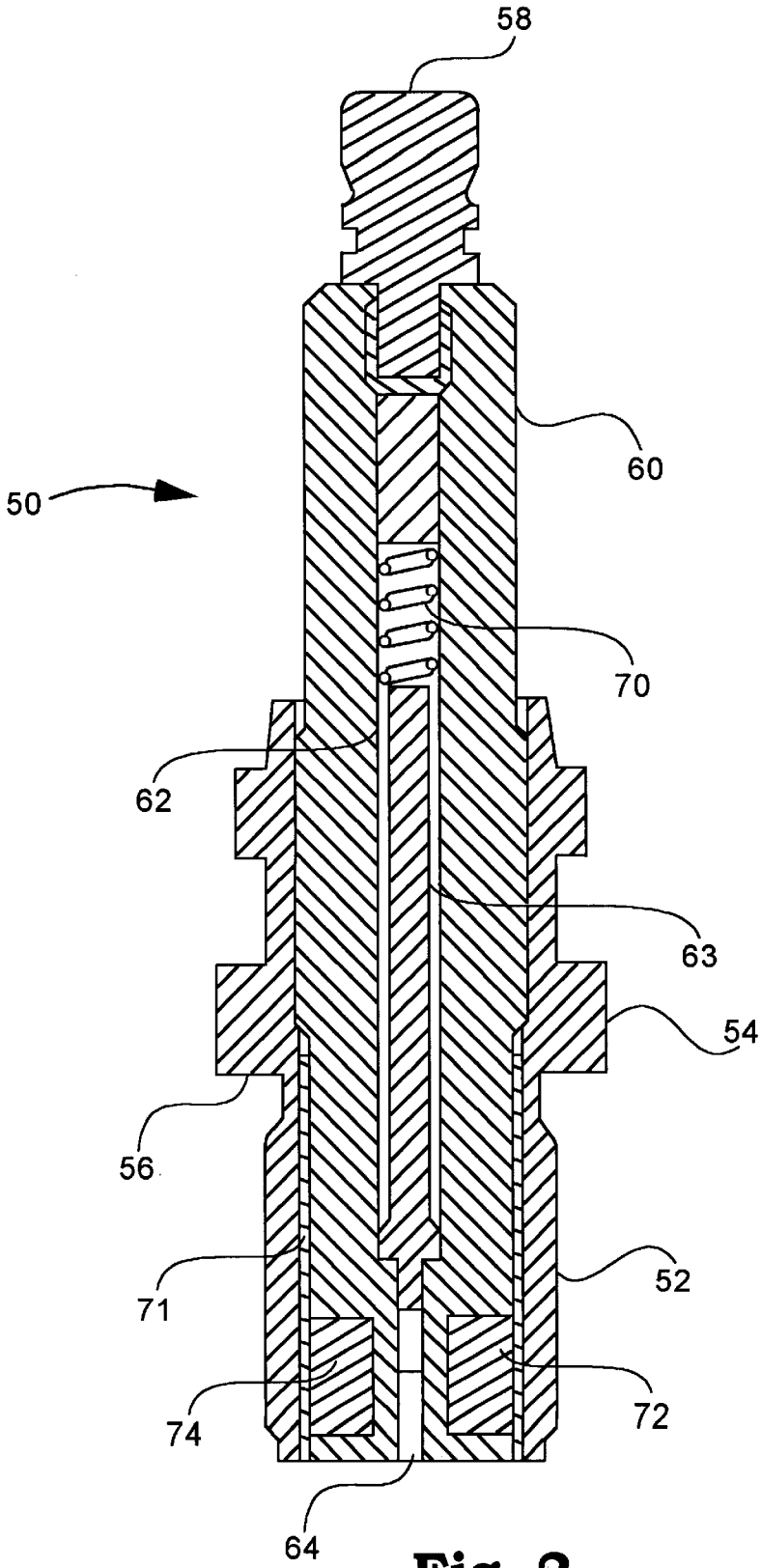
Fig. 2 (Prior Art)
FIG. 2 is a cross-sectional diagram of the spark plug of FIG. 1 viewed from a plane 90 degrees rotated from that of FIG. 1.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Referring now to FIGS. 1–4, an example of one prior art arc-propelling spark plug 50 for use with the spark discharge current control techniques of the present invention is illustrated. In FIG. 1, spark plug 50 includes a housing 54, typically formed of a metallic material, having a threaded portion 52. Threaded portion 52 enables mounting of spark plug 50 within a mating threaded hole in a cylinder block of an internal combustion engine (not shown). Surface 56 of housing 54 mates with a surface of the cylinder block or cylinder head to form an airtight seal with the combustion chamber formed within the cylinder block. Terminal electrode 58 is positioned within a bore 62 of an insulator 60, typically ceramic or similar material, and insulator 60 is fitted into housing 54. A distal end of housing 54 and insulator 64 forms a cavity 64 having a first electrode 66 and a second electrode 68 formed therein. Electrode 66 is attached to housing 54 in a known manner and electrode 68 is preferably electrically connected to terminal electrode 58 via electrode extension 63 and spring 70. In any case, electrodes 66 and 68 form a diverging gap 65 therebetween.

Magnets 72 and 74 (FIG. 2) are positioned within insulator 60 and generally surround the cavity 64. Magnets 72 and 74 produce a magnetic field within cavity 64, and hence within spark gap 65, which is operable to urge an arc established between electrodes 66 and 68 within gap 65 outwardly toward the end of the spark plug 50 as will be described in greater detail hereinafter.

Insulator 60 is preferably made from silicon nitride. Magnets 72 and 74 are preferably made from samarium cobalt, and housing 54 is made from materials typically used in spark plug construction, such as steel or the like. Electrode 58 is preferably made from steel or aluminum and electrodes 66 and 68 are preferably made from steel or similar materials resistant to arc erosion well known in the art of spark plug construction.

Insulator 60 is not a perfect thermal insulator and a heat sink sleeve 71 is preferably provided between magnets 72 and 74 and an inner surface 53 of housing 54 to draw heat, generated in the combustion process, away from magnets 72 and 74 toward housing 54. Preferably, sleeve 71 is formed of a material having high thermal conductivity such as copper or the like.

Figure 3:
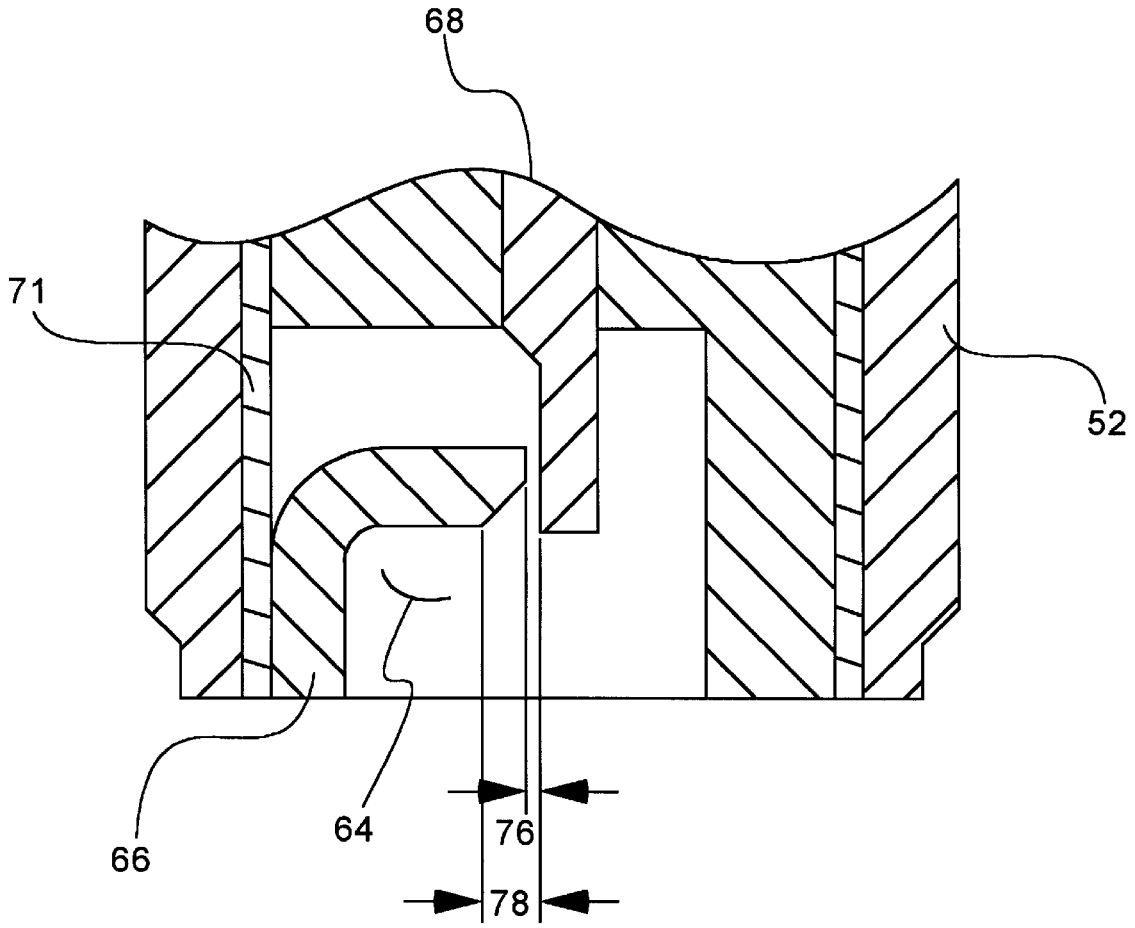
Fig. 3 (Prior Art)
FIG. 3 is a magnified view of the electrodes of the spark plug of FIG. 1.
Figure 4:
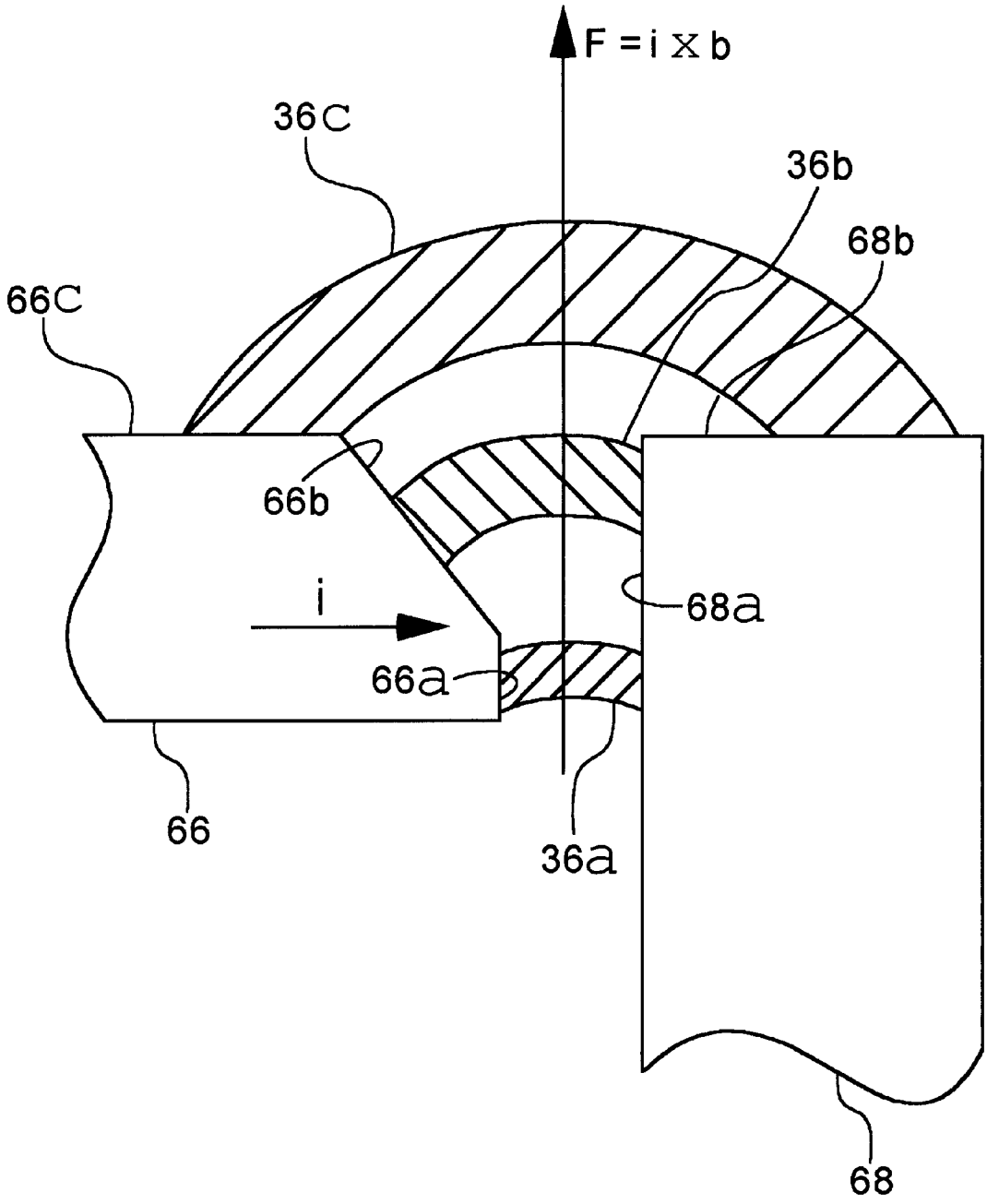
Fig. 4 (Prior Art)
FIG. 4 is a magnified view of the electrodes shown in FIG. 3 depicting the flow of current therebetween as the arc is propelled toward the electrode ends.

Referring now to FIG. 3, an enlarged view of electrodes 66 and 68 are shown. The spark gap formed between electrodes 66 and 68 has a narrow gap 76 that diverges to a larger spark gap 78 due to the configuration of electrode 66. Referring to FIG. 4, an enlarged view of electrodes 66 and 68 are shown. Various arcs 36*a*–36*c* are shown to depict the relative position of an arc created and established between electrodes 66 and 68 in accordance with various power levels of ignition signals delivered to terminal 58 of spark plug 50. In particular, the arc 36*a* is established when a breakdown of the molecules occurs between surfaces 66*a* and 68*a* of electrodes 66 and 68 respectively, thereby generating a plasma area wherein current flow can be established. The plasma contains ions which enable or provide a conduit for current flow. Breakdown of the air gap 76 between surfaces 66*a* and 68*a* is accordingly often referred to as gap ionization. Once gap ionization occurs, current flow is established in the plasma area created by the ionization event, and arc 36*a* is accordingly established. When the resistance of the air gap 76 is broken down resulting from the ionization event, the voltage required to sustain arc 36*a* typically falls off from the voltage required to establish the arc.

Arc 36*a* may be urged toward the position between surface 66*b* of electrode 66 and surface 68*a* of electrode 68, designated by the arc 36*b*, by increasing the level and/or duration of the current I flowing into electrode 66. Likewise, the arc may be urged toward the position between the surface 66*c* of electrode 66 and surface 68*b* of electrode 68, designated by the arc 36*c*, by further increasing the level and/or duration of the current I flowing into electrode 66. In either case, inclusion of magnets 72 and 74 significantly reduces the amount of current required to suitably position the arc between electrodes 66 and 68. The force vector, depicted in FIG. 4 as F, is a graphical representation of the Lorentz force vector acting on arc 36*a–c* in accordance with the formula ixB. The diverging gap defined by electrodes 66 and 68 provides a means for establishing a variable length arc in a spark plug device, which is particularly advantageous when alternate fuel engines are implemented in a vehicle. An example of one such spark plug 50 is described in U.S. Pat. Nos. 5,555,862 and 5,619,959 to Tozzi, which are assigned to the assignee of the present invention, and the disclosures of which are incorporated herein by reference.

Figure 5:
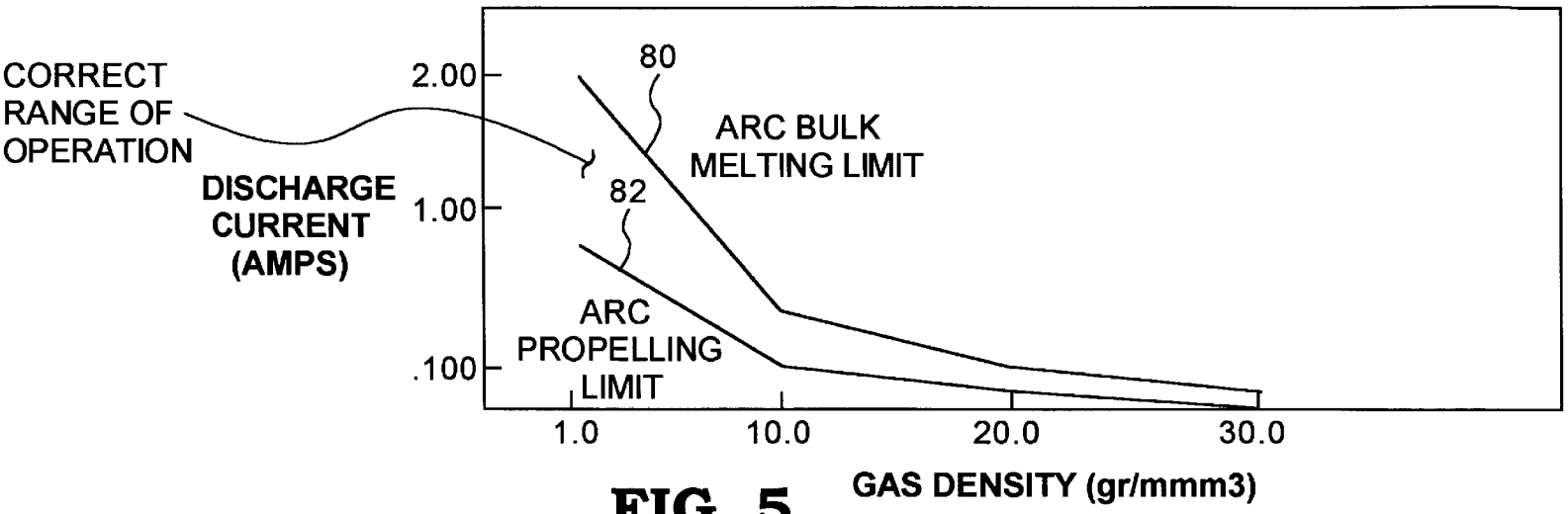
FIG. 5 is a plot of discharge current vs. gas density illustrating a preferred range of discharge current operation to prevent electrode damage while maintaining consistent arc propelling.
Figure 6:
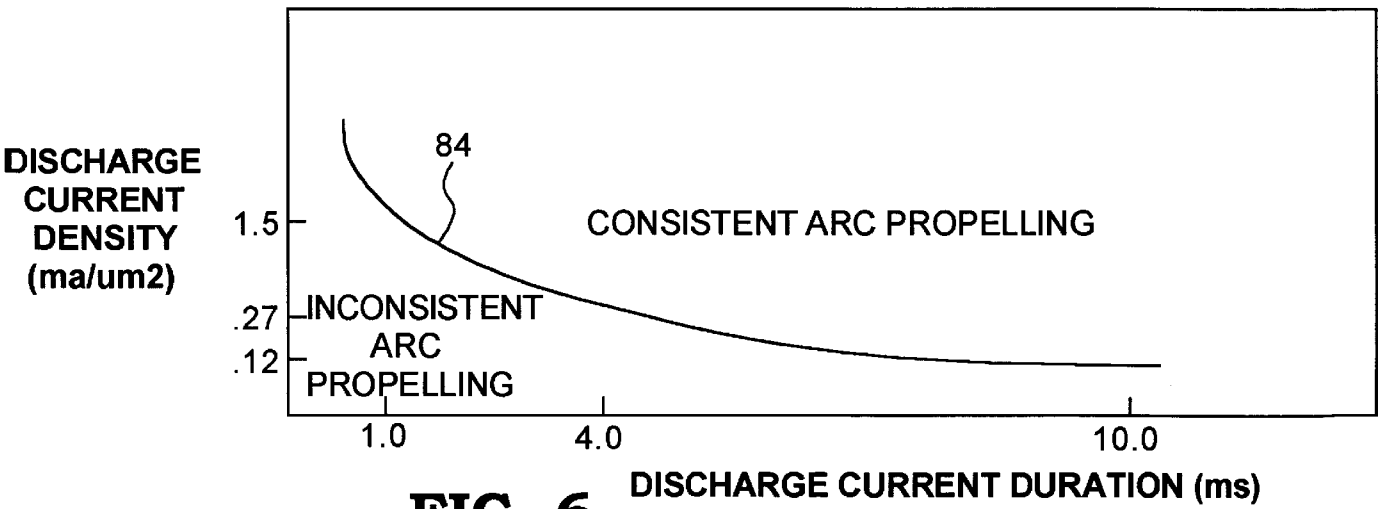
FIG. 6 is a plot of discharge current density vs. discharge current duration illustrating current density value required for consistent arc propelling.

Alternate fuel engines, particularly liquid propane or natural gas engines, typically operate with lean air-fuel mixtures and cylinder pressures at combustion that may vary widely with engine load. Generally, cylinder pressure increases with engine load, and the diameter of arc 36*a–c* accordingly decreases. Thus, whereas the diameter of the arc at light engine load may result in acceptable surface temperatures of electrodes 66 and 68, the diameter of the arc decreases with an increase in engine load so that a correspondingly concentrated arc at high engine load may result in surface temperatures of electrodes 66 and 68 that exceed the melting point thereof. In accordance with the present invention, the current flowing between electrodes 66 and 68 is accordingly controlled to provide for a current density J that is less than a maximum current density above which electrode surface temperatures may exceed a melting point thereof under all engine load conditions. The current flowing between electrodes 66 and 68 must also be controlled to provide for a current density that is greater than a minimum current density below which inconsistent propelling of the arc 36*a–c* may occur. These two criteria are illustrated graphically in FIGS. 5 and 6. FIG. 5 shows discharge current, i of FIG. 4, plotted against gas density which is proportional to cylinder pressure. As illustrated in FIG. 5, waveform 80 marks the maximum discharge current boundary above which electrode surface temperatures may exceed a melting point thereof. Waveform 82 marks the minimum discharge current boundary below which inconsistent propelling of the arc 36*a–c* may occur. Between waveforms 80 and 82, an acceptable discharge current region is defined for the purposes of the present invention. FIG. 6 shows discharge current density plotted against discharge current duration. As evident from FIG. 6, the discharge current density 84 below which inconsistent arc propelling occurs is a decreasing function of time.

Within the acceptable discharge current region defined between waveforms 80 and 82 of FIG. 5, the present invention is concerned with minimizing erosion (due to excessive current flow) of surfaces 66*a* and 66*b* of electrode 66, and of surface 68*a* of electrode 68 while maximizing the ability to ignite fuel at lean air-fuel mixtures. Surfaces 66*c* and 68*b* of electrodes 66 and 68 respectively generally do not contribute to the dimensions of the spark gap 76 and 78 (FIG. 3), and concern over erosion of the surfaces thereof is accordingly lessened. In accordance with the present invention, the discharge current (i of FIG. 4) is preferably controlled to an optimum low current after gap ionization occurs, wherein the low current is just above a current level required for consistent arc propulsion. When the arc has traveled a specified distance along the diverging gap 65, the discharge current is gradually increased to an optimum current level at which ignition of the air-fuel mixture may occur. One preferred embodiment of a system 100 for accomplishing these objectives is illustrated in FIG. 7.

Figure 7:
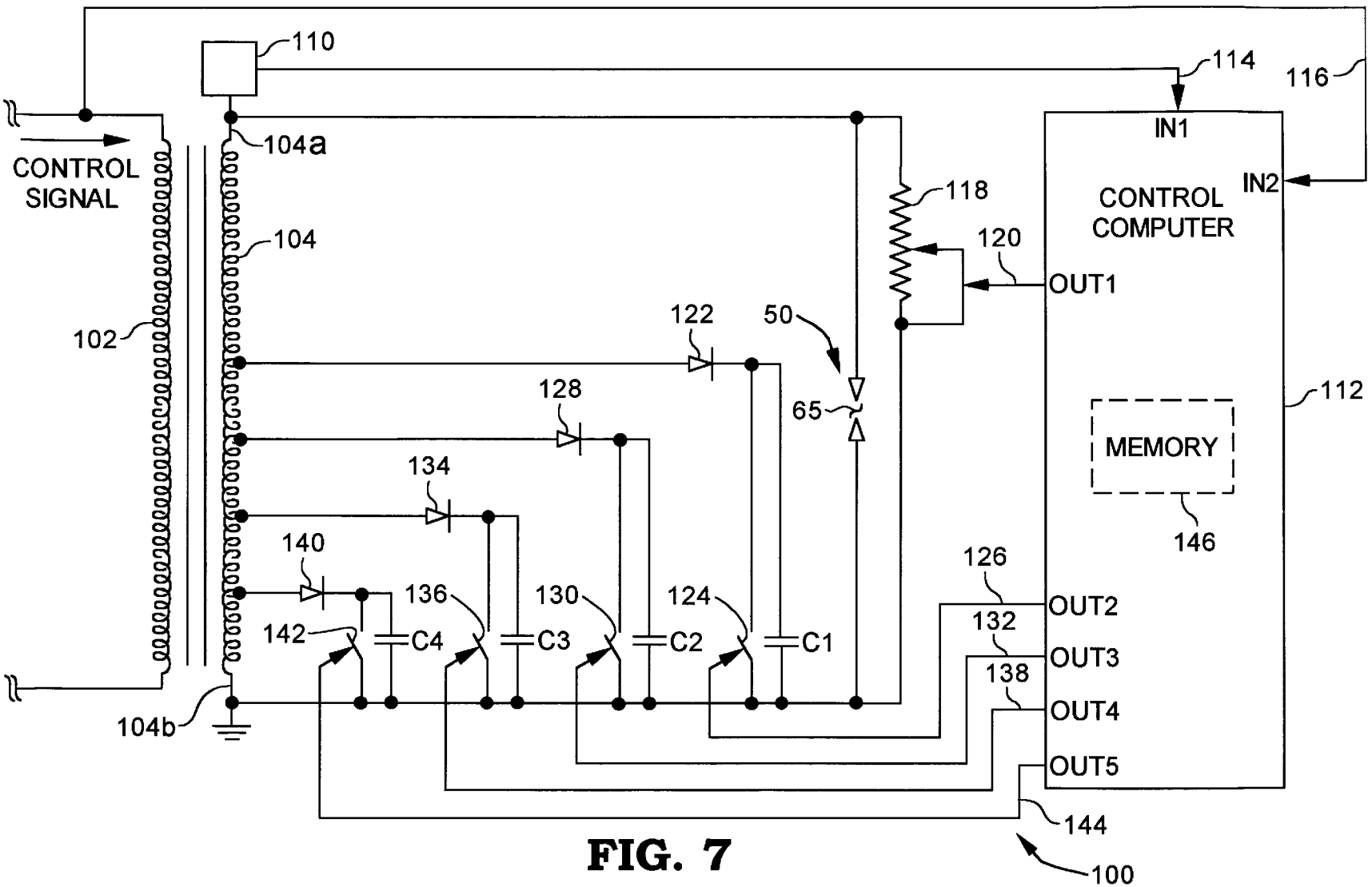
FIG. 7 is a diagrammatic illustration of one embodiment of the controlled energy ignition system of the present invention.

Referring now to FIG. 7, a controlled energy ignition system 100 includes an ignition coil having a primary coil 102 inductively coupled to a secondary coil 104 as is known in the art. One end of the primary coil 102 receives a control signal for activating ignition system 100, and this control signal is provided to an input IN2 of a control computer 112 via signal path 116. Preferably, control computer 112 is microprocessor controlled and includes digital signal processing capabilities as well as a memory portion 146. One end 104*a* of secondary coil 104 is connected to one end of spark plug 50 and to one end of a variable resistor 118, and an opposite end 104*b* of secondary coil 104 is connected to ground potential, to an opposite end of spark plug 50 and to an opposite end of variable resistor 118. Output OUT1 of control computer 112 is connected to variable resistor 118 via signal path 120 for controlling the resistance thereof.

Variable resistor 118 is illustrated in FIG. 7 as a potentiometer having a wiper connected to one end thereof wherein control computer 112 is operable to control the position of the wiper via OUT1. It is to be understood that the structure of variable resistor 118 shown in FIG. 7 represents one embodiment thereof, and the present invention contemplates utilizing any known variable resistor structure controllable by control computer 112 to thereby adjust the value thereof. Examples of known resistor adjustment structures and techniques include, but are not limited to, zener diode controlled resistor structures, so-called R/2R ladder structures, and the like.

End 104*a* of secondary coil 104 is also connected to, or includes integral therewith, a voltage sensor 110 that is connected to input IN1 of control computer 112 via signal path 114. Voltage sensor 110 is preferably a known sensor such as that described in co-pending U.S. patent application Ser. No. 08/988,787 filed on Dec. 11, 1997, by Luigi Tozzi and assigned to the assignee of the present invention, the disclosure of which is incorporated herein by reference. It is to be understood, however, that for purposes of the present invention, voltage sensor 110 may be any known sensor operable to determine a breakdown voltage, $V_{BD}$, corresponding to the voltage required to ionize gap 65 of spark plug 50 as described hereinabove, and provide a corresponding signal to input IN1 of control computer 112.

The secondary coil 104 preferably includes a number of taps each coupled to a capacitor, wherein charging and discharging of the capacitors is controlled by control computer 112. Although four such taps and associated computer controlled capacitors are shown in FIG. 7, it is to be understood that system 100 may include any number of taps/capacitors, the purpose of which will be fully described hereinafter. In the embodiment illustrated in FIG. 7, a first tap to secondary coil 104 is connected to an anode of a diode 122, the cathode of which is connected to one end of a switch 124 and to one end of a capacitor C1. The opposite ends of switch 124 and capacitor C1 are connected to end 104*b* of coil 104. Output OUT2 of control computer 112 is connected to a switch control input of switch 124 via signal path 126 such that control computer 112 is operable to control the opening and closing of switch 124 via OUT2. A second tap to secondary coil 104 is connected to an anode of a diode 128, the cathode of which is connected to one end of a switch 130 and to one end of a capacitor C2. The opposite ends of switch 130 and capacitor C2 are connected to end 104*b* of coil 104. Output OUT3 of control computer 112 is connected to a switch control input of switch 130 via signal path 132 such that control computer 112 is operable to control the opening and closing of switch 130 via OUT3. A third tap to secondary coil 104 is connected to an anode of a diode 134, the cathode of which is connected to one end of a switch 136 and to one end of a capacitor C3. The opposite ends of switch 136 and capacitor C3 are connected to end 104*b* of coil 104. Output OUT4 of control computer 112 is connected to a switch control input of switch 136 via signal path 138 such that control computer 112 is operable to control the opening and closing of switch 136 via OUT4. A fourth tap to secondary coil 104 is connected to an anode of a diode 140, the cathode of which is connected to one end of a switch 142 and to one end of a capacitor C4. The opposite ends of switch 142 and capacitor C4 are connected to end 104*b* of coil 104. Output OUT5 of control computer 112 is connected to a switch control input of switch 142 via signal path 144 such that control computer 112 is operable to control the opening and closing of switch 142 via OUT5. Switches 124, 130, 136 and 140 may be any known electrically controllable switches, and in one embodiment, these switches are provided as MOSFET transistors.

One goal of the present invention is to control discharge current through the spark plug 50 in such a manner so as to minimize electrode erosion, thereby maximizing plug life, while maximizing the ability to ignite fuel at lean air fuel mixtures, thereby optimizing fuel combustion. Referring back to FIG. 4, minimization of electrode erosion is defined for the purposes of spark plug 50 as minimizing erosion, due to current conduction between electrodes 66 and 68, of electrode surfaces 66*a*, 66*b* and 68*a*. These surfaces define the dimensions of spark gap 65 and any erosion thereof results in alteration of these dimensions, which correspondingly affects engine performance and spark plug life. Controlled energy ignition system 100 is accordingly operable, in accordance with one aspect of the present invention, to minimize the spark plug discharge current for arcs 36*a* and 36*b* while also maintaining sufficient discharge current to permit consistent propelling of the arc upwardly toward the position indicated by arc 36*c*. Once the arc is positioned between surface 66*c* of electrode 66 and surface 68*b* of electrode 68, controlled energy ignition system 100 is operable, in accordance with another aspect of the present invention, to increase the spark plug discharge current to a level which permits optimum ignitability of the air-fuel mixture. Since surfaces 66*c* and 68*b* of electrodes 66 and 68 do not directly define any of the boundaries of spark gap 65, some erosion of surfaces 66*c* and 68*b* due to the increase in discharge current is tolerable and will generally not result in degraded engine performance or decreased plug life. The controlled energy ignition system 100 provides for such discharge current control, and details thereof will now be described with respect to FIGS. 7 and 8.

Figure 8:
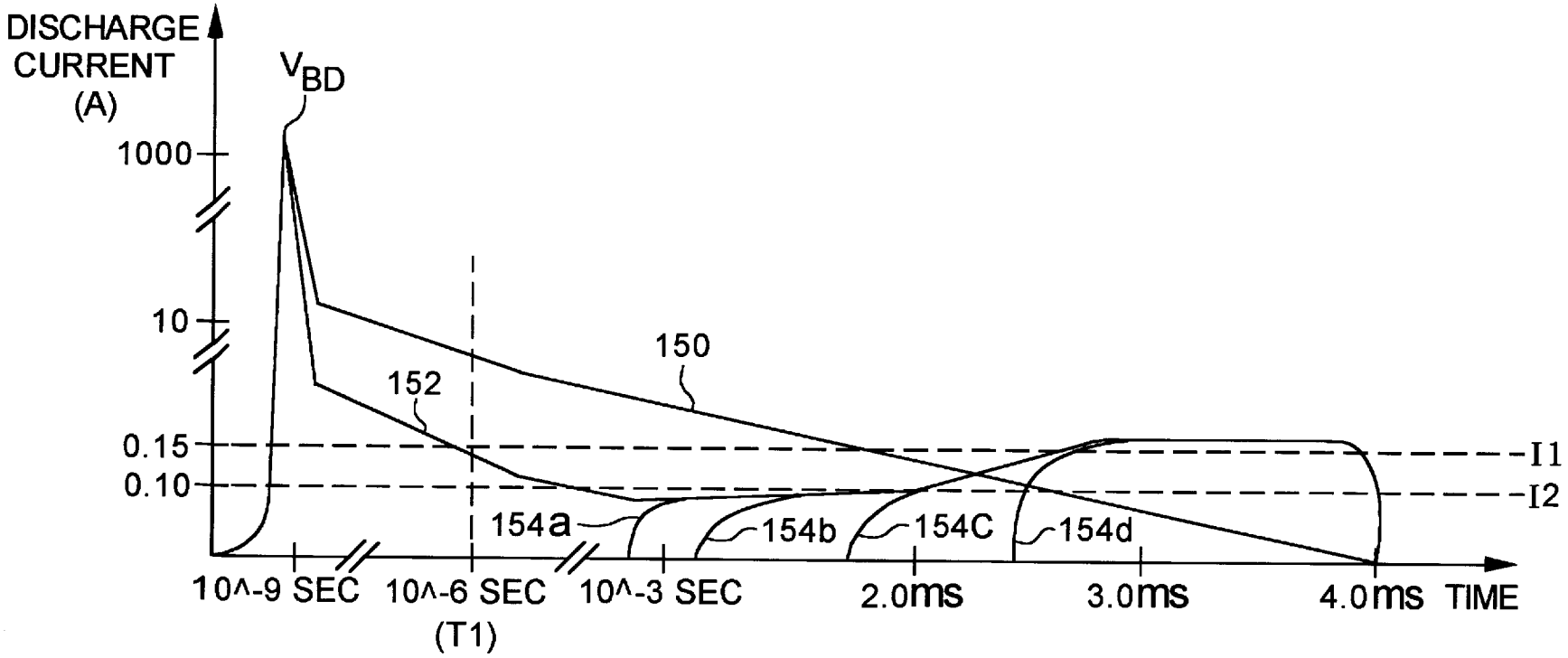
FIG. 8 is a plot of spark plug discharge current over time illustrating some of the spark energy control techniques of the present invention.

Referring specifically to FIG. 8, plot 150 represents a discharge current waveform resulting from a known inductive discharge ignition system as described hereinabove. It has been determined through experimentation that the peak discharge current between the spark plug electrodes, resulting in ionization of the spark gap 65 at a breakdown voltage of $V_{BD}$, generally does not cause significant electrode erosion if the duration thereof is short (e.g. on the order of fractions of nanoseconds). In other words, damage to electrode surfaces 66*a* and 68*b* is minimized if the duration of peak discharge current is short. It has further been determined through experimentation that the discharge current must subsequently be controlled to be below a first discharge current threshold I1 within some time period T1 after starting the ignition event in order to minimize discharge current-induced electrode erosion. The discharge current level must, however, be above a minimum current threshold I2 (which is less than I1) at time T1 in order to provide for subsequent propelling of the arc, under the influence of the magnetic field, in a consistent manner. In one embodiment of spark plug 50, I1=150 mA, I2=100 mA and T1=1 $\mu$s, although the present invention contemplates other values depending upon the type and configuration of spark plug and corresponding spark gap.

In accordance with the present invention, system 100 is operable to control the decay of the discharge current after gap ionization to thereby achieve the desired current level of between I1 and I2 at time T1 as illustrated in the discharge current waveform 152 of FIG. 8. In one embodiment, control computer 112 is operable to provide such control by adjusting the value of the variable resistor 118 to thereby control the discharge current decay rate. As described hereinabove with respect to FIG. 5, the current density of the discharge current increases with increasing cylinder pressure, wherein cylinder pressure increases with engine load. Thus, as engine load varies, it is desirable to accordingly control the discharge current level to maintain the discharge current density below a level which results in excessive electrode surface temperatures while maintaining the discharge current density above a level which permits consistent propelling of the arc. Thus, control computer 112 is operable to control the discharge current level after gap ionization based on current engine load conditions to thereby minimize electrode erosion rate while providing for consistent propelling of the arc over all engine load conditions. In the embodiment shown in FIG. 8, control computer 112 is preferably operable to provide such control by first determining engine load, preferably by determining cylinder pressure based on $V_{BD}$ at gap ionization, mapping cylinder pressure to a desired value of variable resistor 118, and adjusting the value of variable resistor 118 to the desired value via output OUT1. Those skilled in the art will, however, recognize that other techniques may be used for relating engine load to discharge current level, and that such techniques may be used to adjust the value of the discharge current to some desired value or range of values within some time period after starting the ignition without deviating from the scope of the present invention.

Figure 9:
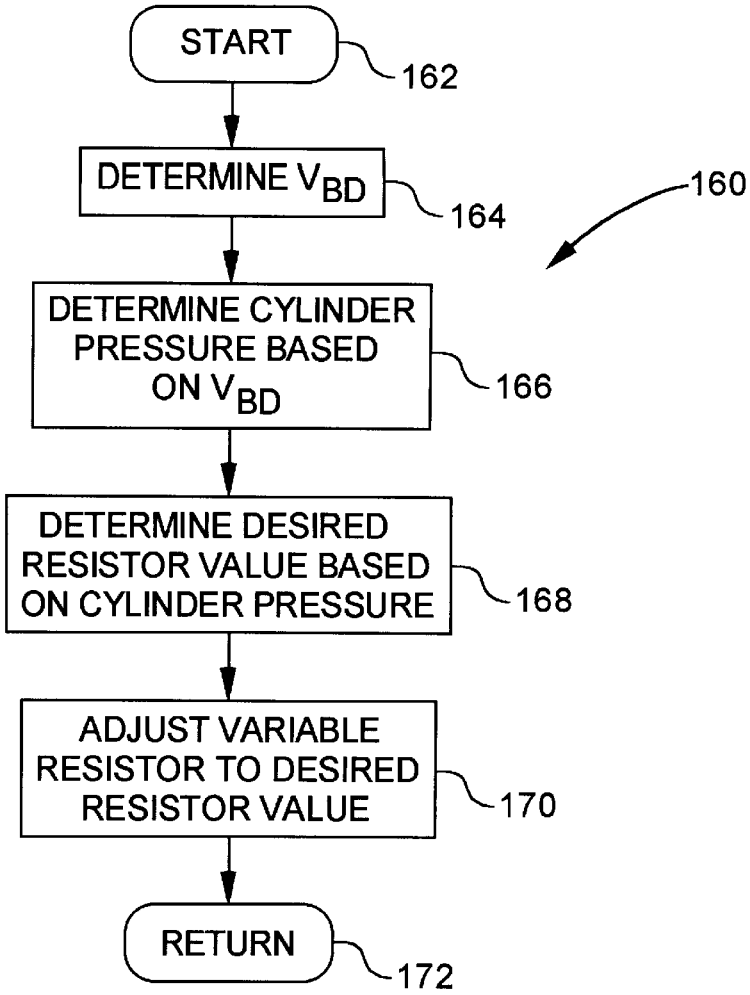
FIG. 9 is a flowchart illustrating one preferred embodiment of a software algorithm for controlling the discharge current to a desired current range following gap ionization.

Referring now to FIG. 9, one embodiment of a flowchart 160 for controlling discharge current level for a time period following gap ionization, in accordance with one of the techniques described above, is shown. Algorithm 160 is preferably executable by control computer 112 many times per second as is known in the art. Algorithm 160 begins at step 162 and at step 164, control computer 112 is operable to determine the breakdown voltage, $V_{BD}$, at gap ionization. Preferably, control computer 112 is operable to execute step 164 by processing the spark voltage waveform provided to input IN1 thereof by sensor 110, and determining $V_{BD}$ therefrom in accordance with known techniques. Thereafter at step 166, control computer 112 is operable to determine cylinder pressure based on $V_{BD}$. As is known in the art, cylinder pressure is proportional to engine load and cylinder pressure is related to $V_{BD}$ via Paschen's law:

$$V_{BD}=K_1*(\text{gap})*(\text{pressure})/ln\,(K_2*\text{gap}*\text{pressure}) \quad (1),$$

wherein $K_1$ and $K_2$ are constants, gap is the width of the spark gap 76 (FIG. 3) and pressure is the cylinder pressure. Computer 112 is preferably operable at step 166 to compute cylinder pressure based on equation (1).

Figure 10:
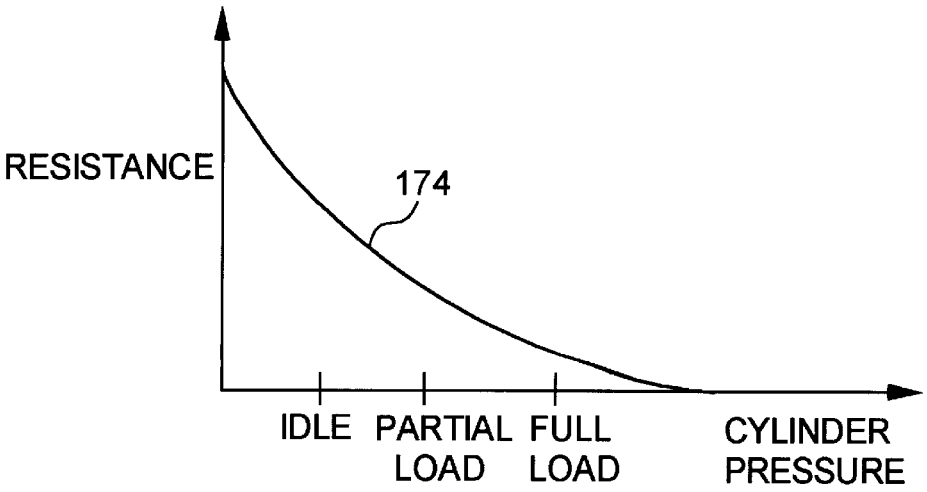
FIG. 10 is a plot of resistance vs. cylinder pressure illustrating one preferred technique for mapping current engine load to a desired resistor value for adjusting the variable resistor shown in FIG. 7.

Thereafter at step 168, control computer 112 is operable to determine a desired resistor value based on the cylinder pressure value determined in step 166. FIG. 10 illustrates one preferred technique for relating cylinder pressure to desired resistance value, wherein resistance 174 is plotted against cylinder pressure, and wherein engine load indicators are shown which correspond to associated cylinder pressure values. Thus, at no load, or idle, conditions, the desired resistor value is high, and the desired resistor value decreases, preferably according to a chosen function, as engine load increases. The relationship between desired resistor values and cylinder pressure values is preferably stored within memory portion 146 of control computer 112, and may be represented therein as an equation (either continuous or piecewise continuous), a graph or plot as shown in FIG. 10, or as a look-up table. In any case, control computer 112 is operable at step 168 to map a current cylinder pressure value to a desired resistor value. Thereafter at step 170, control computer 112 is operable to adjust the value of the variable resistor 118 to the desired resistor value, using any one or more known techniques, some of which were described hereinabove. Algorithm execution continues from step 170 at step 172 where algorithm execution is returned to its calling routine, or alternatively loops back to step 164 for continuous execution of algorithm 160.

It should now be apparent that system 100 is, in accordance with one aspect thereof, operable to draw current away from spark plug 50 following gap ionization to thereby control the discharge current to within a desired range of discharge current values based on engine load conditions, gap structure and gap width.

Referring again to FIGS. 7 and 8, system 100 is further operable to controllably increase the discharge current to a current level suitable for igniting the air fuel mixture after the arc has reached the position illustrated by arc 36*c* of FIG. 4. As described hereinabove, some erosion of surfaces 66*c* and 68*b* is permissible since these surfaces do not form any of the boundaries of spark gap 65. Thus, as the time of air-fuel mixture ignition approaches, control computer 112 is preferably operable to increase the discharge current to a current level at which optimal igniting of the air-fuel mixture occurs. In one preferred embodiment, system 100 is operable to controllably increase the discharge current by sequentially controlling the positions of the various switches 124, 130, 136 and 140.

At the beginning of the ignition event, the control signal is applied to the primary coil 102 which induces a corresponding voltage in the secondary coil 104 and current through coil 104 increases rapidly, as is known in the art, until gap ionization occurs, after which the discharge current is controllably decreased as described above. As the gap ionization event occurs, switches 124, 130, 136 and 140 are all preferably open, thereby charging each of the capacitors C1–C4. Control computer 112 is operable to control each of the switches 124, 130, 136 and 140 at predetermined time intervals after the ignition event begins, wherein activation of the control signal marks the beginning of each ignition event, and control computer 112 is responsive to the control signal supplied thereto via input IN2 to establish a corresponding time mark. In one embodiment of spark plug 50 and corresponding internal combustion engine (not shown), it has been determined that the discharge current arc reaches the position indicated at 36*c* of FIG. 4 approximately 2.0 milli-seconds after the ignition event begins, and the actual air-fuel ignition event occurs between 3.0–4.0 milli-seconds after the ignition event begins. Control computer 112 is accordingly operable to controllably increase the discharge current level, via control of switches 124, 130, 136 and 140, such that the discharge current is set to a level at which optimal igniting of the air-fuel mixture occurs between 3.0–4.0 milli-seconds.

In the embodiment illustrated in FIG. 7, control computer 112 is preferably operable to sequentially close switches 124, 130, 136 and 140 to thereby cause the voltage stored in each of the capacitors to be impressed across corresponding portions of the windings of the secondary coil 104, thereby sequentially adding supplemental currents (represented by lines 154*a*, 154*b*, 154*c* and 154*d* in FIG. 8) to the discharge current. Thus, as illustrated in FIG. 8, control computer 112 is operable to close switch 124 just prior to 1.0 ms after the start of the ignition event, close switch 130 just after 1.0 ms after the start of the ignition event, close switch 136 just prior to 2.0 ms after the start of the ignition event, and close switch 140 just after 2.0 ms after the start of the ignition event. The resulting effect is to ramp the discharge current 152 to approximately 170 mA between 3.0–4.0 ms after the start of the ignition event, which corresponds to the actual time of igniting the air-fuel mixture. It is to be understood that the foregoing description is illustrative of only one particular application of the discharge current increasing technique of the present invention, and that the present invention contemplates providing for the desired ignition discharge current at any time interval following commencement of the ignition event, and by using any number of capacitor/switch combinations. Those skilled in the art will recognize that the number of capacitor/switch combinations used will be dictated by the desired shape of the discharge current waveform 152 leading up to air-fuel mixture ignition.

Figure 11:
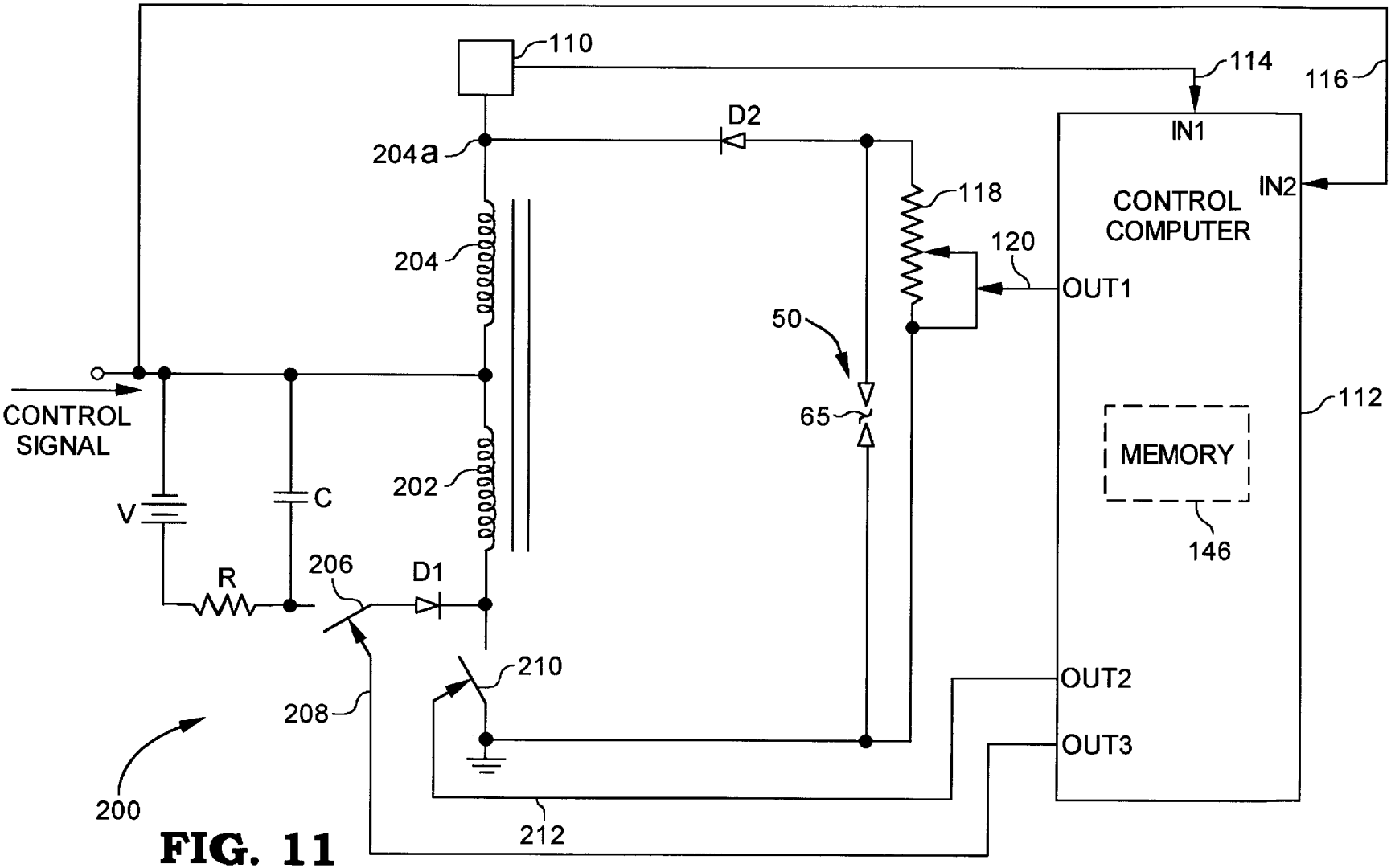
FIG. 11 is a diagrammatic illustration of an alternate embodiment of the controlled energy ignition system of the present invention.

Referring now to FIG. 11, an alternate embodiment of a controlled energy ignition system 200, in accordance with the present invention, is shown. System 200 is identical in many respects to system 100 of FIG. 7, and like numbers are accordingly used to identify like elements. Unlike elements of system 200 include an ignition coil having a primary coil 202 inductively coupled to a secondary coil 204 as is known in the art. One end of the primary coil 202 is connected to a capacitor C, to one end of a voltage source V and to one end of the secondary coil 204, and receives a control signal for activating system 200. The opposite end of the capacitor C is connected to one end of a switch 206 and to one end of a resistor R. The opposite end of the resistor R is connected to an opposite end of the voltage source V, and the opposite end of the switch 206 is connected to the anode of a diode D1, the cathode of which is connected to an opposite end of the primary coil 202 and to one end of a second switch 210. A control input to switch 206 is connected to an output OUT2 of control computer 112 via signal path 208. The opposite end of switch 210 is connected to ground potential and to one end of spark plug 50 and variable resistor 118. A control input to switch 210 is connected to an output OUT3 of control computer 112 via signal path 212. End 204*a* of secondary coil 204 is connected to voltage sensor 110 and to a cathode of a second diode D2, the anode of which is connected to opposite ends of spark plug 50 and variable resistor 118. The remaining structure illustrated in FIG. 11 is identical to like numbered components described with respect to FIG. 7.

Figure 12:
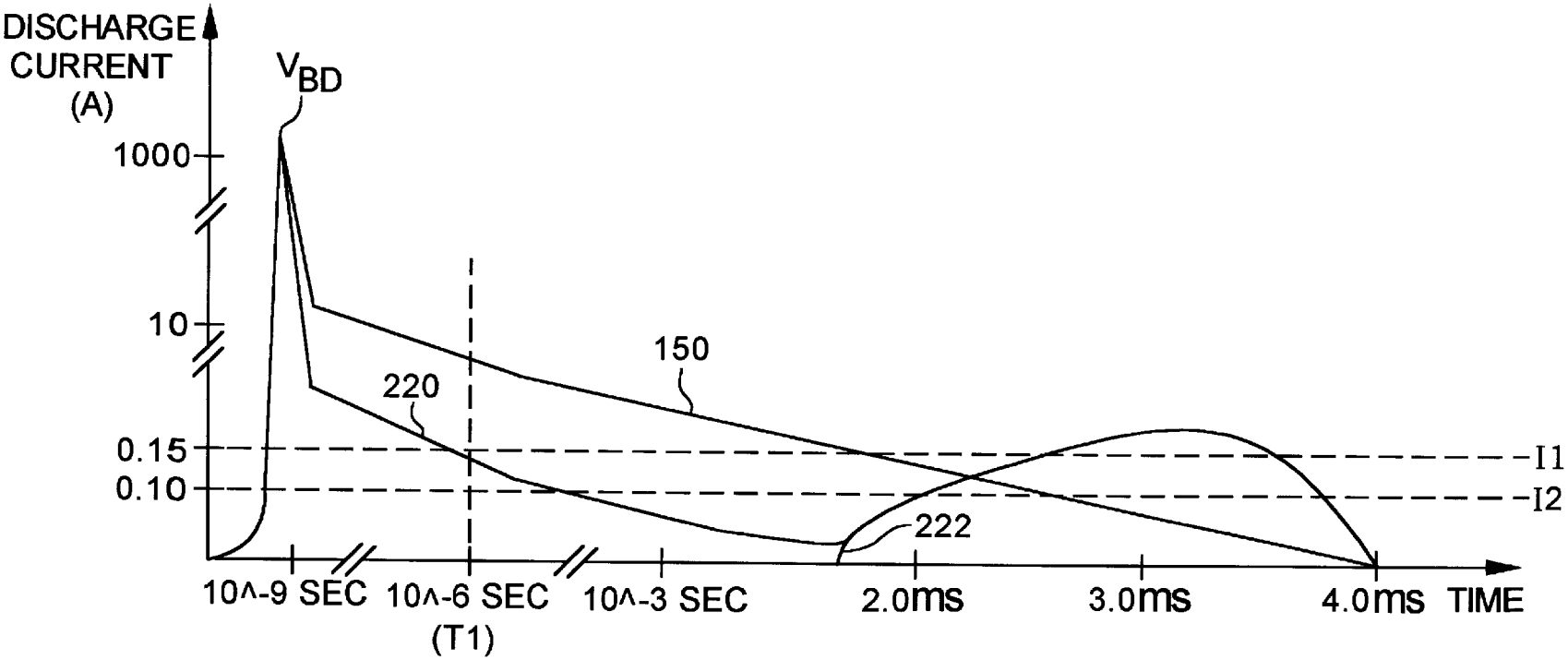
FIG. 12 is a plot of spark plug discharge current vs. time for the system shown in FIG. 11 illustrating some of the spark energy control techniques of the present invention.

In operation, control computer 112 is responsive to the control signal provided at input IN1 thereof to close switch 210 which completes the coil circuit and causes the spark plug discharge current 220, as illustrated in FIG. 12, to rise. System 200 is preferably operable to control the decrease of the discharge current after gap ionization as described hereinabove, so that the discharge current level is between I1 and I2 at a time T1 after starting the ignition event. Thereafter, the discharge current 220 continues to decay until sometime between 1.0–2.0 ms after starting the ignition event, when the control computer 112 is operable to close switch 206, thereby causing the voltage on capacitor C, which was pre-charged to a suitable voltage by voltage source V, to be impressed upon the primary coil 202. This induces an additional or supplemental current in the secondary coil 204, resulting in an approximately sinusoidal increase in the discharge current 220 as indicated at 222 in FIG. 12. System 200 is thus operable to increase the discharge current to a suitable level for igniting the air-fuel mixture at a desired time range after starting the ignition event. Unlike system 100, however, system 200 is operable to provide this capability by controllably impressing additional voltage on the primary coil 202 rather than on the secondary coil 204 as in system 100. Both systems produce the expected results, although system 200 is less complicated in that is does not require high voltage capacitors (which would typically be required for capacitors C1–C4 of system 100), and does not require configuring the secondary coil 204 for multiple tap locations. It is to be understood that the foregoing description is illustrative of only another particular application of the discharge current increasing technique of the present invention, and that the present invention contemplates providing for the desired ignition discharge current at any time interval following commencement of the ignition event, and by using any number of capacitor/switch combinations. Those skilled in the art will recognize that the number of capacitor/switch combinations used will be dictated by the desired shape of the discharge current waveform 220 leading up to air-fuel mixture ignition.

While the invention has been illustrated and described in detail in the foregoing drawings and description, the same is to be considered as illustrative and not restrictive in character, it being understood that only one preferred embodiment thereof has been shown and described and that all changes and modifications that come within the spirit of the invention are desired to be protected. For example, while the present invention has been described herein as being directed to techniques for controlling the discharge current in a diverging gap spark plug having means for magnetically propelling the arc along the diverging gap, those skilled in the art will recognize that the concepts described herein are applicable to controlling the shape of the discharge current in ignition systems having conventional spark plugs as well, and that control of such systems is intended to fall within the scope of the present invention.

What is claimed is:

1. A controlled energy ignition system for an internal combustion engine, comprising:

an ignition plug having first and second electrodes defining a spark gap therebetween;

an ignition coil connected to said first and second electrodes of said ignition plug, said ignition coil responsive to a control signal to produce a discharge current across said spark gap; and a resistor connected across said spark gap, said resistor sized to limit said discharge current below a first threshold current level within a first predefined time period following generation of said control signal.

2. The controlled energy ignition system of claim 1 wherein said resistor is further sized to maintain said discharge current above a second threshold current, said second threshold current less than said first threshold current.

3. The controlled energy ignition system of claim 1 wherein said ignition coil includes a primary coil coupled to a secondary coil, said primary coil responsive to said control signal to induce a spark voltage across said secondary coil, said secondary coil responsive to said spark voltage to produce said discharge current.

4. The controlled energy ignition system of claim 3 further including means for sensing said spark voltage and producing a spark voltage signal corresponding thereto.

5. The controlled energy ignition system of claim 4 wherein said resistor is a variable resistor;

and further including means responsive to said spark voltage signal to adjust a resistance value of said variable resistor to thereby limit said discharge current below said first threshold current level as a function of said spark voltage signal.

6. The controlled energy ignition system of claim 5 wherein said means responsive to said spark voltage signal to adjust a resistance value of said variable resistor is further operable to adjust said resistance value of said variable resistor to thereby maintain said discharge current above a second threshold current level, said second threshold current level less than said first threshold current level.

7. The controlled energy ignition system of claim 6 further including means for increasing said discharge current above said threshold current level within a second predefined time period following generation of said control signal.

8. The controlled energy ignition system of claim 1 wherein said ignition plug extends into a combustion chamber of an internal combustion engine.

9. A controlled energy ignition system for an internal combustion engine, comprising:

an ignition plug having first and second electrodes defining a spark gap therebetween;

an ignition coil having a primary coil coupled to a secondary coil, said primary coil responsive to a first control signal to induce a spark voltage across said secondary coil, said secondary coil responsive to said spark voltage to produce a discharge current across said spark gap;

means for sensing said spark voltage and producing a spark voltage signal corresponding thereto;

a variable resistor connected across said spark gap and responsive to a second control signal to adjust a resistance value thereof; and a control computer responsive to said spark voltage signal to produce said second control signal, thereby adjusting said resistance value of said variable resistor as a function of said spark voltage signal.

10. The controlled energy ignition system of claim 9 wherein said control computer is responsive to said spark voltage signal to determine a breakdown voltage at which ionization of said spark gap occurs, said control computer determining a desired resistance value of said variable resistor based on said breakdown voltage and producing said second control signal according thereto.

11. The controlled energy ignition system of claim 10 wherein said ignition plug extends into a combustion cylinder of an internal combustion engine.

12. The controlled energy ignition system of claim 11 wherein said control computer includes means for determining from said breakdown voltage a corresponding pressure within said combustion cylinder.

13. The controlled energy ignition system of claim 12 wherein said control computer includes means for determining said desired resistance value from said corresponding pressure within said combustion cylinder.

14. A controlled energy ignition system for an internal combustion engine, comprising:

an ignition plug having first and second electrodes defining a spark gap;

an ignition coil including a primary coil coupled to a secondary coil, said primary coil responsive to a control voltage to produce spark voltage across said secondary coil, said secondary coil having a high tension side connected to said first electrode and a low tension side connected to said second electrode, said secondary coil responsive to said spark voltage to produce a first discharge current across said spark gap;

a first capacitor having one end coupled to said secondary coil between said high and low tension sides thereof and an opposite end connected to one of said first and second electrodes; and means for controllably discharging said first capacitor to thereby produce a supplemental voltage across a portion of said secondary coil, said secondary coil responsive to said supplemental voltage to produce a second discharge current across said spark gap supplementing said first discharge current.

15. The controlled energy ignition system of claim 14 wherein said means for controllably discharging said first capacitor includes:

a first switch connected across said first capacitor and having a switch input responsive to a switch signal to activate said switch; and a control computer responsive to said control voltage to produce said switch signal a predefined time period following activation of said control voltage.

16. The controlled energy ignition system of claim 14 wherein said means for producing a supplemental voltage includes a number of capacitors each coupled at different locations to said secondary coil between said high and low tension sides thereof;

and wherein said means for controllably discharging said first capacitor is operable to sequentially discharge each of said number of capacitors to thereby sequentially increase said second discharge current to a predefined current value.

17. A controlled energy ignition system for an internal combustion engine, comprising:

an ignition plug having first and second electrodes defining a spark gap;

an ignition coil including a primary coil coupled to a secondary coil, said primary coil responsive to a control voltage to produce spark voltage across said secondary coil, said secondary coil connected to said first and second electrodes, said secondary coil responsive to said spark voltage to produce a first discharge current across said spark gap;

a capacitor connected across said primary coil; and means for controllably discharging said capacitor to thereby produce a supplemental voltage across said primary coil, said primary coil responsive to said supplemental voltage to induce a corresponding supplemental spark voltage across said secondary coil, said secondary coil responsive to said supplemental spark voltage to produce a second discharge current supplementing said first discharge current.

18. The controlled energy ignition system of claim 17 wherein said means for controllably discharging said capacitor includes:

a switch disposed between one end of said capacitor and said primary coil, said switch having a switch input responsive to a switch signal to activate said switch; and a control computer responsive to said control voltage to produce said switch signal a predefined time period following activation of said control voltage.

* * * * *